US010759638B2

(12) United States Patent
Lautwein et al.

(10) Patent No.: US 10,759,638 B2
(45) Date of Patent: Sep. 1, 2020

(54) DRIVE TRAIN FOR HOISTING GEAR

(71) Applicant: M.A.T. Malmedie Antriebstechnik GmbH, Solingen (DE)

(72) Inventors: Christof Lautwein, Friesenhagen (DE); Christian Spura, Castrop-Rauxel (DE); Christoph Wagener, Geldern (DE)

(73) Assignee: M.A.T. Malmedie Antriebstechnik GmbH, Solingen (DE)

( * ) Notice: Subject to any disclaimer, the term of this patent is extended or adjusted under 35 U.S.C. 154(b) by 404 days.

(21) Appl. No.: 14/892,705

(22) PCT Filed: Feb. 12, 2014

(86) PCT No.: PCT/EP2014/052693
§ 371 (c)(1),
(2) Date: Nov. 20, 2015

(87) PCT Pub. No.: WO2014/187578
PCT Pub. Date: Nov. 27, 2014

(65) Prior Publication Data

US 2016/0101969 A1 Apr. 14, 2016

(30) Foreign Application Priority Data

May 21, 2013 (DE) ..... 10 2013 209 361

(51) Int. Cl.
*B66D 1/16* (2006.01)
*B66D 1/58* (2006.01)
(Continued)

(52) U.S. Cl.
CPC ..... *B66D 1/16* (2013.01); *B66D 1/12* (2013.01); *B66D 1/14* (2013.01); *B66D 1/54* (2013.01); *B66D 1/58* (2013.01); *B66D 5/00* (2013.01)

(58) Field of Classification Search
CPC ... B66D 1/14; B66D 1/16; B66D 1/12; B66D 1/54; B66D 1/58; B66D 5/00
See application file for complete search history.

(56) References Cited

U.S. PATENT DOCUMENTS 3,573,518 A * 4/1971 Liles ..... H02K 49/065 310/103
4,434,972 A * 3/1984 Charles ..... B66D 1/52 254/340
(Continued)

FOREIGN PATENT DOCUMENTS

CN 202226588 U 5/2012
DE 1556374 A1 4/1970
(Continued)

OTHER PUBLICATIONS

International Preliminary Report on Patentability dated Nov. 24, 2015 in International Application No. PCT/EP2014/052693.
(Continued)

*Primary Examiner* — Sang K Kim
*Assistant Examiner* — Nathaniel L Adams
(74) *Attorney, Agent, or Firm* — Panitch Schwarze Belisario & Nadel LLP

(57) ABSTRACT

A drive train is provided for hoisting gears, and in particular for hazardous transports. The drive train includes a drive motor (1), a cable drum (6) connected thereto, a reduction transmission (5) arranged between the drive motor (1) and the cable drum (6), a service brake (4) provided between the drive motor (1) and the reduction transmission (5) and a safety brake (7). To prevent damage to the reduction transmission (5) in the event of an emergency stop braking an automatic overrun disconnect means can be provided between the drive motor (1) and the service brake (4). The overrun disconnect means is preferably in the form of a freewheel (2).

12 Claims, 1 Drawing Sheet

(51) Int. Cl.

| | |
|---|---|
| ***B66D 1/14*** | (2006.01) |
| ***B66D 1/12*** | (2006.01) |
| ***B66D 1/54*** | (2006.01) |
| ***B66D 5/00*** | (2006.01) |

(56) References Cited

U.S. PATENT DOCUMENTS

| | | | | |
|---|---|---|---|---|
| 6,883,784 | B1 * | 4/2005 | Sloneker | B66D 1/04 254/366 |
| 7,896,315 | B2 * | 3/2011 | Faust | B66D 1/58 254/275 |
| 2005/0072965 | A1 | 4/2005 | Sanders et al. | |
| 2008/0140289 | A1 * | 6/2008 | Gross | B66D 1/58 701/50 |

FOREIGN PATENT DOCUMENTS

| | | | |
|---|---|---|---|
| DE | 102004062515 | A1 | 6/2006 |
| EP | 1661845 | A1 | 5/2006 |

OTHER PUBLICATIONS

International Search Report dated Mar. 28, 2014 in International Application No. PCT/EP2014/052693.

* cited by examiner

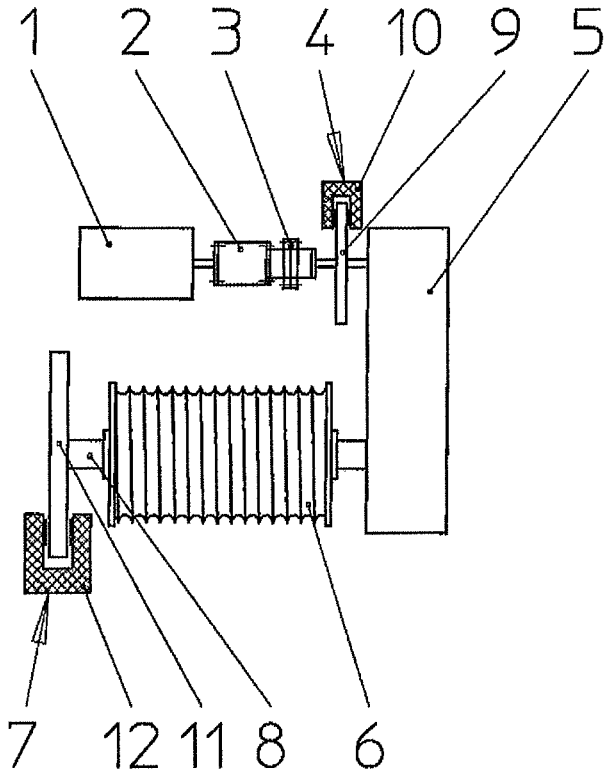
1
2
3
4
10
9
5
7
12
11
8
6

DRIVE TRAIN FOR HOISTING GEAR

CROSS-REFERENCE TO RELATED APPLICATIONS

This application is a Section 371 of International Application No. PCT/EP2014/052693, filed Feb. 12, 2014 which was published in the German language on Nov. 27, 2014 under International Publication No. WO 2014/187578 A1 and the disclosure of which is incorporated herein by reference.

BACKGROUND OF THE INVENTION

The invention concerns a drive train for hoisting gears, in particular for hazardous transports, comprising a drive motor, a cable drum connected thereto, a reduction transmission arranged between the drive motor and the cable drum, a service brake provided between the drive motor and the reduction transmission and a safety brake.

If hoisting gears are provided for the transport of hazardous items, for example molten materials or also radioactive materials, a safety brake is generally also provided in the drive train, besides the service brake. The safety brake which serves for emergency stop braking is normally carried on the shaft of the cable drum.

In an emergency stop braking situation in a "lower" load situation there is a reversal in the load direction and thus a torque shock occurs in the transmission, as a consequence of different application times for the safety brake and the service brake. That torque shock leads to an overload as well as stressing in the transmission. That overload and transmission stressing which occur upon emergency stop braking result in particular from the rotating inertial masses of the motor and the transmission.

BRIEF SUMMARY OF THE INVENTION

Therefore the object of the invention is to avoid the torque shock linked to the reversal in the load direction and the stresses caused thereby in the transmission.

According to an embodiment of the invention that object is attained in that provided between the drive motor and the service brake is an automatic overrun disconnect means.

These features according to an embodiment of the invention provide that the rotating masses of the motor are separated from the drive train. Damage in the drive train and in particular in the reduction transmission are prevented by that separation. In addition that separation causes a reduction in the stopping distance of the hoisting gear and the load suspended therefrom.

The automatic overrun disconnect means provided between the drive motor and the service brake can be an overrun coupling which is preferably in the form of a freewheel.

Freewheels can be designed in accordance with different structural patterns, in which respect they are provided for example with clamping rollers, clamping members, toothed disks, wrap springs or locking pawls. A particularly advantageous freewheel structure which is suitable for the situation of use of the invention is a clamping roller freewheel which is not only highly effective but also operates completely noiselessly.

Alternatively the overrun disconnect means can also be in the form of a releasable coupling which is electrically switched in the event of emergency stop braking. The rotating masses of the motor can also be quickly and effectively separated from the drive train with such a structure so that the reduction transmission does not suffer any damage.

BRIEF DESCRIPTION OF THE DRAWING

The foregoing summary, as well as the following detailed description of the invention, will be better understood when read in conjunction with the appended drawing. For the purpose of illustrating the invention, there is shown in the drawing an embodiment which is presently preferred. It should be understood, however, that the invention is not limited to the precise arrangements and instrumentalities shown.

In the drawing:

FIG. 1 shows a drive train according to the invention.

DETAILED DESCRIPTION OF THE INVENTION

A drive train for a hoisting gear comprises a drive motor 1, a freewheel 2, a coupling 3, a service brake 4, a reduction transmission 5, a cable drum 6 and a safety brake 7 which is prescribed in particular in relation to transport for hazardous items. The safety brake 7 is carried on the same shaft 8 as the cable drum 6 and is disposed downstream of the cable drum 6 in the embodiment illustrated in FIG. 1.

The service brake 4 comprises a brake disk 9 which is surrounded at least on one side by a brake caliper 10 with corresponding brake pads.

The safety brake 7 also includes a brake disk 11 which is surrounded at at least one location by a brake caliper 12 on which suitably actuable brake pads are provided.

In the embodiment illustrated in FIG. 1, both the service brake 4 and also the safety brake 7 are designed in the manner of a disk brake.

The freewheel 2 arranged between the drive motor 1 and the coupling 3 is desirably in the form of a noiselessly operating clamping roller freewheel.

The coupling 3 arranged in FIG. 1 between the freewheel 2 and the service brake 4 is in the form of a rigid coupling.

Alternatively the coupling 3 can also be in the form of an electrically switchable releasable coupling to separate the drive motor 1 from the reduction transmission 5. For that specified case it would be possible to dispense with a freewheel 2.

If an emergency stop is triggered when lowering the suspended load the service brake 4 and the safety brake 7 are closed. By virtue of the usual brake dimensioning the safety brake 7 which serves as the emergency off stopping brake requires a shorter application time than the service brake 4. As a result the rotary movement of the cable drum 6 is stopped before the rotary movement of the input shaft of the reduction transmission has come to a halt. Thus, without the measures according to the invention, a shock torque would occur, which acts in the opposite direction to the actual load direction.

That torque transmitted by the inertia mass of the drive motor 1, in conventional drive trains, causes a shock-like reversal in direction of the torque in the transmission. The time process of the reversal in direction of the torque takes place during the difference in application times between the safety brake 7 and the service brake 4.

Then, in the conventional drive trains, the inertia mass in opposite relationship to the load direction produces in the reduction transmission 5 a change in tooth flank from the load flank to the opposite flank (rearward load flank). As a result of that, a shock loading occurs at the opposite flank, which in the conventional drive trains would lead to considerable damage to the transmission. That transmission damage can range from slight surface damage to the tooth flank to tooth breakage and thus failure of the transmission.

Such damage is very effectively prevented by the arrangement of an automatic overrun disconnect means or the freewheel 2 in the drive train according to the invention. It is already the case that upon response of the safety brake 7 which has a very short application time the freewheel 2 takes effect immediately upon stoppage of the reduction transmission 5, that is to say the torque of the inertial rotating masses of the drive motor, due to the response of the freewheel 2, is no longer transmitted to the reduction transmission 5 which is connected directly to the cable drum 6. The action of the freewheel 2 takes place immediately with actuation of the safety brake 7, and more specifically still before the service brake 4 provided with a lesser application time comes into engagement.

Consequently only one torque direction is predetermined by the arrangement of the freewheel 2 in the drive train according to the invention so that, in the event of emergency stop braking, no damage to the reduction transmission can occur. The features according to the invention can thus effectively protect a corresponding drive train for hoisting gears from damage so that the service life thereof is increased.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A drive train for hoisting gears comprising:

a drive motor, a cable drum connected thereto, a reduction transmission arranged between the drive motor and the cable drum, a service brake provided between the drive motor and the reduction transmission, a safety brake, formed in combination with a shaft of the cable drum, configured to serve as an emergency off stopping brake, and having a shorter actuation time than an actuation time of the service brake, and an overrun disconnect means arranged between the drive motor and the service brake, the overrun disconnect means being configured to transmit torque from the drive motor to the reduction transmission in only one direction and configured to automatically cease transmitting torque in an opposite direction upon actuation of the safety brake when lowering a suspended load.

2. The drive train of claim 1, wherein the overrun disconnect means is an overrun coupling.

3. The drive train of claim 2, wherein the overrun coupling is a freewheel.

4. The drive train of claim 3, wherein the freewheel is a clamping roller freewheel.

5. The drive train of claim 3, wherein the freewheel is configured to allow rotation of the drive motor and reduction transmission together in a load direction, and is configured to prevent rotation together in a direction opposite the load direction without mechanical de-coupling.

6. The drive train of claim 3, wherein the freewheel activates without an external signal.

7. The drive train of claim 1, wherein the overrun disconnect means is a releasable coupling.

8. The drive train of claim 7, wherein the releasable coupling is electrically switchable.

9. The drive train of claim 1, wherein the cable drum includes a cable drum shaft that is distinct from a motor drive shaft, and wherein the safety brake is connected to the cable drum shaft.

10. The drive train of claim 9, wherein the cable drum shaft has a longitudinal axis that differs from a longitudinal axis of the motor drive shaft.

11. The drive train of claim 9, wherein the safety brake comprises a disk brake, wherein a disk of the disk brake is attached to the cable drum shaft in a radial direction with respect to a longitudinal axis of the cable drum shaft.

12. The drive train of claim 1, wherein the only one direction is a direction corresponding to lowering the suspended load.

* * * * *